US006773578B1

(12) United States Patent
O'Rear et al.

(10) Patent No.: US 6,773,578 B1
(45) Date of Patent: Aug. 10, 2004

(54) PROCESS FOR PREPARING LUBES WITH HIGH VISCOSITY INDEX VALUES

(75) Inventors: Dennis J. O'Rear, Petaluma, CA (US); Joseph A. Biscardi, Berkeley, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 178 days.

(21) Appl. No.: 09/729,215

(22) Filed: Dec. 5, 2000

(51) Int. Cl.[7] ..... C10G 70/00; C10G 73/02; C10G 73/06; C10G 1/04; C10G 35/04

(52) U.S. Cl. ..... 208/28; 208/18; 208/27; 208/33; 208/87; 208/134

(58) Field of Search ..... 208/27, 28, 18, 208/33, 87, 143, 134

(56) References Cited

U.S. PATENT DOCUMENTS

| | | | | |
|---|---|---|---|---|
| 3,614,475 | A | 10/1971 | Offutt et al. | |
| 3,773,650 | A | 11/1973 | Hislop et al. | 208/33 |
| 3,775,288 | A | 11/1973 | Eagen et al. | 208/33 |
| 3,902,988 | A | 9/1975 | Bennett et al. | 208/80 |
| 4,176,050 | A | 11/1979 | Chen et al. | 208/111 |
| 4,181,598 | A | 1/1980 | Gillespie et al. | 208/58 |
| 4,211,635 | A | 7/1980 | Chen | 208/93 |
| 4,222,855 | A | 9/1980 | Pelrine et al. | 208/111 |
| 4,229,282 | A | 10/1980 | Peters et al. | 208/111 |
| 4,259,170 | A | 3/1981 | Graham et al. | 208/93 |
| 4,477,333 | A | 10/1984 | Hafez | 73/2 |
| 4,622,130 | A | 11/1986 | Stem | 208/87 |
| 4,627,901 | A | 12/1986 | Ryan et al. | 204/190 |
| 4,678,556 | A | 7/1987 | Hicks et al. | 208/86 |
| 4,702,817 | A | 10/1987 | Ryan et al. | 208/28 |
| 4,820,400 | A | 4/1989 | Ryan et al. | 208/38 |
| 4,898,674 | A | 2/1990 | Pasternak et al. | 210/638 |
| 4,917,789 | A | 4/1990 | Butler et al. | |
| 4,919,788 | A | 4/1990 | Chen et al. | 208/59 |
| 4,943,672 | A | 7/1990 | Hamner, deceased et al. | 585/737 |
| 4,950,382 | A | 8/1990 | Yao et al. | 585/737 |
| 5,015,361 | A | 5/1991 | Anthes et al. | 208/28 |
| 5,049,536 | A | 9/1991 | Bellussi et al. | 502/235 |
| 5,082,986 | A | 1/1992 | Miller | 585/667 |
| 5,096,883 | A | 3/1992 | Mercer et al. | 507/103 |
| 5,110,445 | A | 5/1992 | Chen et al. | 208/96 |
| 5,135,638 | A | 8/1992 | Miller | 208/27 |
| 5,189,012 | A | 2/1993 | Patel et al. | 507/103 |
| 5,200,101 | A | 4/1993 | Hsu et al. | 252/47.5 |
| 5,246,566 | A | 9/1993 | Miller | 208/27 |
| 5,282,958 | A | 2/1994 | Santilli et al. | 208/111 |
| 5,302,279 | A | 4/1994 | Degnan et al. | 208/87 |
| 5,360,530 | A | 11/1994 | Gould et al. | 208/34 |
| 5,614,079 | A | 3/1997 | Farnos et al. | 208/27 |
| 5,723,716 | A | 3/1998 | Brandes et al. | 585/734 |
| 5,898,023 | A | 4/1999 | Francisco et al. | 508/236 |
| 5,977,425 | A | 11/1999 | Brandes et al. | 585/734 |
| 6,008,164 | A | 12/1999 | Aldrich et al. | 508/110 |
| 6,051,127 | A | 4/2000 | Moureaux | 208/58 |
| 6,080,301 | A | 6/2000 | Berlowitz et al. | 208/18 |
| 6,179,994 | B1 | 1/2001 | Clark et al. | 208/27 |

FOREIGN PATENT DOCUMENTS

| | | |
|---|---|---|
| EP | 225 053 B1 | 10/1986 |
| EP | 582 347 B1 | 7/1993 |
| EP | 659 478 B1 | 12/1994 |
| EP | 668 342 A1 | 2/1995 |
| EP | 464 546 B1 | 7/1995 |
| EP | 0 712 922 A2 | 5/1996 |
| GB | 819121 A | 8/1957 |
| WO | WO 96/13563 | 5/1996 |
| WO | WO 96/26993 | 9/1996 |
| WO | 00/77125 A1 | 12/2000 |

OTHER PUBLICATIONS

*Chemical Technology of Petroleum,* 3rd Edition, William Gruse and Donald Stevens, McGraw–Hill Book Company, Inc., New York, 1960, pp. 566 to 570.
Sequeira: "The Mobil Lube Dewaxing Process" pp. 198–204.
J. D. Hargrove G. J. Elkes and A. H. Richardson Oil and Gas J. p. 103–110 Jan. 15, 1979.
Search Report dated Feb. 11, 2003.
United Kingdom Search Report dated Aug. 13, 2003.

*Primary Examiner*—Walter D. Griffin
*Assistant Examiner*—Tam M. Nguyen
(74) *Attorney, Agent, or Firm*—Burns, Doane, Swecker & Mathis, L.L.P.

(57) ABSTRACT

Lube base stocks and lube stock compositions, as well as a process for preparing lube base stocks and lube stock compositions, are disclosed. The lube oils preferably have a viscosity index above about 115. The process involves obtaining feedstocks that have a 95% point below 1150° F. and feedstocks that have 95% point above 1150° F. The feedstocks that have a 95% point below 1150° F. are catalytically dewaxed, and the feedstocks that have 95% point above 1150° F. are solvent dewaxed. The resulting products can optionally be blended, and the base stocks can be combined with various additives to form lube oil compositions. Hydrotreatment can optionally be performed on the lube base stocks to remove olefins, oxygenates and other impurities. In one embodiment, one or more of the fractions are obtained from Fischer-Tropsch synthesis. One or more of the fractions can also be obtained from other sources, for example, via distillation of crude oil, provided that the fractions do not include appreciable amounts (i.e., amounts which would adversely affect the catalyst used for catalytic isodewaxing) of thiols or amines. The individual fractions can also include combinations of feedstocks, from Fischer-Tropsch and other sources.

20 Claims, No Drawings

PROCESS FOR PREPARING LUBES WITH HIGH VISCOSITY INDEX VALUES

FIELD OF THE INVENTION

This invention relates to a process for preparing lube base stocks.

BACKGROUND OF THE INVENTION

Lubricants used in automobiles, diesel engines and other equipment are composed of base stocks and/or base oils and additives. Base stocks and base oils are typically hydrocarbons and are divided into five groups according to their sulfur content, saturates content, and viscosity index, according to the API Interchange Guidelines (API Publication 1509).

| Group | Sulfur, ppm | | Saturates, % | V.I. |
|---|---|---|---|---|
| I | >300 | And/or | <90 | 80–120 |
| II | ≦300 | And | ≧90 | 80–120 |
| III | ≦300 | And | ≧90 | >120 |
| IV | All Polyalphaolefins (PAOs) | | | |
| V | All Stocks Not Included in Groups I–IV | | | |

Plants that make Group I base stocks from crude oil-derived lube base stock feedstocks typically solely use solvents such as phenol or furfural to extract the lower VI components and increase the VI of the fractions to the desired specifications. Solvent extraction typically gives a product with less than 90% saturates and more than 300 ppm sulfur. The majority of the lube production is in the Group I category.

Plants that make Group II base stocks from crude oil fractions in a "pre-lube base stock range" typically use hydroprocessing (hydrocracking or severe hydrotreating) to increase the VI of the fractions to the specification value. Hydroprocessing typically increases the saturate content above 90 and reduces the sulfur below 300 ppm. Combinations of solvent processing with hydroprocessing are also used to make Group II base stocks. Approximately 10% of the world lube base stock production, and about 30% of U.S. production, is in the Group II category.

Plants that make Group III base stocks typically use Hydroisomerization Dewaxing to make very high VI products. The starting feed is typically a waxy vacuum gas oil (VGO) or wax which contains essentially saturates and little sulfur. The Group III products have saturate contents above 90 and sulfur contents below 300 ppm. Fischer Tropsch wax is an ideal feed for Hydroisomerization Dewaxing to make Group III lubes. However, only a small fraction of the world's lube supply is in the Group III category. Group IV and V plants are specialty plants, and make up even less of the world's lube supply.

In addition to specifications on saturates, viscosity index and sulfur, lube base stocks are typically produced in a series of viscosity grades. The lowest viscosity is almost always greater than 3 cSt when measured at 40° C., and more typically greater than 4 cSt. The highest viscosity grade is almost always less than 50 cSt when measured at 100° C. The finished lube oil formulator takes various viscosity grade products and blends them with additives to make a finished lubricant that has a desired viscosity. The proportions of the individual base stocks and/or base oils are adjusted to achieve the desired viscosity of the finished lubricant. Since a lube base oil plant must provide base oils for a variety of customers, it is important that all viscosity grades have other properties that are approximately constant, such as viscosity index, pour point, cloud point, etc. The viscosity of the lube base stock depends on the average molecular weight of the base stock and this, in turn, depends on the boiling range.

Lube base stocks must have acceptable pour points and cloud points in addition to an acceptable viscosity index. These properties can be important for functional considerations (they impact the actual performance of the final lubricant) and can be important for general customer acceptance. Pour point is typically measured using the ASTM 97 procedure, which measures the temperature at which an oil no longer will flow when it is cooled. Cloud point is typically measured using the ASTM D 2500 procedure, which measures the temperature at which a cloud appears in the lube base stock as it is cooled.

Pour point is of obvious functional significance as the final lubricant must not become solid during storage or use. Typical lube base stocks (Groups I–III) will have pour points below +10° F. (−12° C.). These specifications are satisfactory for the majority of lube base stocks used in engine lubrication. Chemical pour point depressants can be added to lube base stocks to further reduce their pour point, but these chemical additives are expensive. For a few small volume applications intended for cold climates, lower pour points may be needed.

Cloud point is also of functional significance where an oil filter is used to remove solids from the lubricant. Lube base stocks with high cloud points may plug the oil filter. Typical lube Group I–III base stocks will have cloud points below +14° F. (−10° C.). While chemical pour point depressants are known, analogous cloud point depressants are not known. As with the pour point, these cloud point specifications are satisfactory for the majority of lube base stocks used in engine lubrication. For a few small volume applications intended for cold climates, lower cloud points may be needed.

Wax is commonly removed from lube base stocks by Solvent Dewaxing. Solvent Dewaxing to make lube base stocks has been used for over 70 years. An advantage of using Solvent Dewaxing is that the product pour and cloud points are reduced to approximately the same value. Limitations of Solvent Dewaxing include high operating costs, use of volatile and flammable solvents, environmental problems due to solvent emissions in the air and groundwater, and production of slack wax for which there is a limited market.

The traditional method of Solvent Dewaxing is being supplanted by Catalytic Dewaxing. The trend began with Conventional Hydrodewaxing and has continued recently with Hydroisomerization Dewaxing (for example, Chevron's Isodewaxing™ process). One disadvantage of Catalytic Dewaxing is the tendency for the process to generate oils that have cloud points higher than their pour points.

It would be advantageous to have processes for preparing lube base stock and lube stock compositions that minimize the limitations associated with Solvent Dewaxing, and that also provide lube base stocks with cloud points relatively close (i.e., within about 30° C., preferably with about 20° C., most preferably within about 10°C.) to their pour points. The smallest pour-cloud spread is preferred because this requires less dewaxing and thus permits pertaining higher lube yields which improves economics. The present invention provides such processes.

SUMMARY OF THE INVENTION

In its broadest aspect, the present invention is directed to an integrated process for producing more than one viscosity grade of lube base stock and lube stock compositions. Hydrocarbons in the lube base stock range are prepared by catalytically dewaxing feedstocks that have a 95% point below 1150° F. and solvent dewaxing feedstocks that have a 95% point above 1150° F. Optionally, the solvent dewaxed fraction can additionally be subjected to Hydroisomerization Dewaxing, preferably Complete Hydroisomerization Dewaxing, before or after Solvent Dewaxing. Hydrotreatment can optionally be performed on the lube base stock to remove olefins, oxygenates and other impurities. By use of different dewaxing processes depending on the 95% point, more than one viscosity grade of lube base stock can be generated while maintaining relatively consistent pour and cloud points.

In one embodiment, the process involves performing Fischer-Tropsch synthesis on syngas to provide a range of products, and isolating various fractions (i.e., fractions that have a 95% point below 1150° F. and fractions that have a 95% point above 1150° F.), typically via fractional distillation. The fractions can also be obtained from other sources, for example via distillation of crude oil, provided that the fractions do not include appreciable amounts (i.e., amounts which would adversely affect the Dewaxing Catalyst) of thiols or amines. The individual fractions can also include combinations of feedstocks, from Fischer-Tropsch and other sources. The resulting dewaxed hydrocarbon products can optionally be combined with an additive package to provide a lube oil composition.

Products with desired properties can be tailor made by performing the appropriate Solvent Dewaxing or Catalytic Dewaxing steps on representative samples of each fraction, blending the resulting products, and assaying them for desired properties. Once a product with optimized properties is obtained, the conditions can be scaled up to provide a desired product stream.

DETAILED DESCRIPTION OF THE INVENTION

In its broadest aspect, the present invention is directed to an integrated process for producing lube base stocks and lube oils. As used herein, lube base stocks and/or base oils are generally combined with an additive package to provide finished lube oils. Hydrocarbons in the lube base stock range are prepared by catalytically dewaxing feedstocks that have a 95% point below 1150° F. and solvent dewaxing feedstocks that have 95% point above 1150° F. The 95% points can be measured by use of ASTM D2887.

The process described herein is an integrated process. As used herein the term "integrated process" refers to a process which involves a sequence of steps, some of which may be parallel to other steps in the process, but which are interrelated or somehow dependent upon either earlier or later steps in the total process.

As used herein, "pour point" is the temperature at which an oil no longer will flow when it is cooled, "cloud point" is the temperature at which a cloud appears in the lube base stock as it is cooled, and the "95% point" is the temperature at which 95% of the product distills.

An advantage of the present process is the effectiveness with which the present process may be used to prepare high quality base stocks useful for manufacturing lubricating oils, particularly while minimizing the product loss associated with Solvent Dewaxing and/or Catalytic Dewaxing of the entire feedstock, as well as minimizing the spread between the pour and cloud points. The pour point/cloud point spread, or pour-cloud spread, is defined as the cloud point minus the pour point, as measured in ° C.

While not wishing to be bound to a particular theory, as shown below in Example 1, Applicants have determined that fractions with 95% points below about 1150° F. have a pour point/cloud point spread that is approximately constant, at about 7° C., with little tendency for the spread to increase with an increase in product VI. Accordingly, Catalytic Dewaxing can be performed with minimal loss in product yield. However, fractions with 95% points above about 1150° F. have a relatively large pour point/cloud point spread (for example, above 30° C.) and Catalytic Dewaxing may result in an unacceptable loss in product yield. The process herein, by subjecting these two fractions to different dewaxing conditions, maximizes product yield while maintaining an acceptable pour point.

As used herein, "hydrocarbons in the lube base stock range" are hydrocarbons having a boiling point in the lube oil range (i.e., between 650 and 1200° F.).

Feedstocks for the Solvent Dewaxing and Catalytic Isodewaxing Steps

Any hydrocarbon feedstock including primarily paraffins and isoparaffins and with a 95% point below 1150° F. can be used for Catalytic Dewaxing. Any hydrocarbon feedstock including primarily paraffins and isoparaffins and with a 95% point above 1150° F. can be used for Solvent Dewaxing. In one embodiment, one or both fractions (1150° F.+ and 1150° F.− fractions) are derived at least in part from Fischer-Tropsch synthesis. The fractions can also be obtained from other sources, for example, via distillation of crude oil, provided that the fractions do not include appreciable amounts (i.e., amounts which would adversely affect the Dewaxing Catalyst) of thiols or amines. The individual fractions can also include combinations of feedstocks, i.e., from Fischer-Tropsch and other sources.

Examples of feedstocks that can be used in the processes described herein include oils that generally have relatively high pour points which it is desired to reduce to relatively low pour points. Numerous petroleum feedstocks, for example, those derived from crude oil, are suitable for use. Examples include petroleum distillates having a normal boiling point above about 212° F., gas oils and vacuum gas oils, residuum fractions from an atmospheric pressure distillation process, solvent-deasphalted petroleum residues, shale oils, cycle oils, petroleum and slack wax, waxy petroleum feedstocks, NAO wax, and waxes produced in chemical plant processes. Straight chain n-paraffins either alone or with only slightly branched chain paraffins having 16 or more carbon atoms can be considered to be waxes.

Suitable feedstocks also include those heavy distillates normally defined as heavy straight-run gas. The feedstock may have been subjected to a hydrotreating and/or hydrocracking process before being supplied to the present process. Alternatively, or in addition, the feedstock may be treated in a solvent extraction process to remove aromatics and sulfur- and nitrogen-containing molecules before being dewaxed.

Additional examples of suitable feeds include waxy distillate stocks such as gas oils, lubricating oil stocks, synthetic oils and waxes such as those produced by Fischer-Tropsch synthesis, high pour point polyalphaolefins, foots oils, synthetic waxes such as normal alpha-olefin waxes, deoiled waxes and microcrystalline waxes. Foots oil is prepared by separating oil from the wax, where the isolated oil is referred to as foots oil.

As used herein, the term "waxy petroleum feedstocks" includes petroleum waxes. The feedstock employed in the process of the invention can be a waxy feed which contains greater than about 50% wax, and in some embodiments, even greater than about 90% wax. Wax content can be determined by use laboratory solvent dewaxing methods. A 300-g portion of sample is dissolved in 1200 ml of 1:1 toluene-MEK solvent. Heating may be necessary to achieve complete dissolution. The solution is then cooled overnight at −15 to −20 degrees F to crystallize the wax. The wax crystals formed are filtered and recovered. The filtrate is vacuum distilled to separate the toluene-MEK solvent from the dewaxed oil. Occluded solvent in the wax is removed by heating the wax on a hot plate with nitrogen blowing on the surface. The weights of the recovered oil and wax are divided by the original sample weight to obtain the percent oil and wax.

Highly paraffins feeds having high pour points, generally above about 0° C., more usually above about 10° C. are also suitable for use in the process of the invention. Such feeds can contain greater than about 70% paraffinic carbon, and in some embodiments, even greater than about 90% paraffinic carbon. The content of paraffinic carbon can be determined by NMR techniques.

The feedstocks should not include appreciable amounts of olefins, heteroatoms, aromatics or other cyclic compounds. Preferred feedstocks are products from Fischer-Tropsch synthesis or waxes from petroleum products. If any heteroatoms, olefins or cyclic compounds are present in the feedstock, they can be removed, for example, by hydrotreating.

In one embodiment, one or more of the fractions (i.e., the fraction boiling below 1150° F. and the fraction boiling above 1150° F. the relatively low molecular weight fraction are obtained via Fischer-Tropsch synthesis.

The Fischer-Tropsch synthesis may be effected in a fixed bed, in a slurry bed, or in a fluidized bed reactor. The Fischer-Tropsch reaction conditions may include using a reaction temperature of between 1 90° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferably, the catalysts are operated with high chain growth probabilities (i.e., alpha values of 0.8 or greater, preferably 0.9 or greater, most preferably 0.925 or greater). Preferred promoters are those influencing the surface area of the reduced iron ('structural promoters'), and these include oxides or metals of Mn, Ti, Mg, Cr, Ca, Si, Al, or Cu or combinations thereof.

The products from a slurry bed Fischer-Tropsch synthesis generally include a gaseous reaction product and a liquid reaction product. The gaseous reaction product includes hydrocarbons boiling below about 650° F. (e.g., tail gases through middle distillates). The liquid reaction product includes hydrocarbons boiling above about 650° F. (e.g., vacuum gas oil through heavy paraffins).

The minus 650° F. product can be separated into a tail gas fraction and a condensate fraction, i.e., equivalent to about $C_5$ to $C_{20}$ normal paraffins and higher boiling hydrocarbons, using, for example, a high pressure and/or lower temperature vapor-liquid separator or low pressure separators or a combination of separators. Advantageously, the $C_{20}$+ Fischer-Tropsch products are used in the Catalytic Dewaxing process, and $C_5$ to $C_{20}$ normal paraffins are used for other purposes, for example, to prepare distillate fuel compositions.

The fraction boiling above about 650° F. primarily contains $C_{20}$ to $C_{50}$ linear paraffins with relatively small amounts of higher boiling branched paraffins.

The overall process generally involves obtaining a fraction with a 95% point below 1150° F. and a fraction with a 95% point above 1150° F. The fraction with a 95% point below 1150° F. is subjected to Catalytic Dewaxing and the fraction with a 95% point above 1150° F. is subjected to Solvent Dewaxing conditions. Optionally, the feedstock to the Solvent Dewax process is additionally be subjected to Hydroisomerization Dewaxing. Hydrotreatment can optionally be performed on the lube base stock to remove olefins, oxygenates and other impurities.

Conditions for Solvent Dewaxing, Catalytic Dewaxing, and hydrotreatment are described in more detail below.

The higher boiling fractions, e.g., the 1150° F.+ fractions, are dewaxed in a conventional Solvent Dewaxing step to remove high molecular weight n-paraffins. The recovered dewaxed product, or dewaxed oil, can be fractionated under vacuum to produce paraffinic lubricating oil fractions of different viscosity grades, or blended directly with the catalytically dewaxed fractions. High wax content 1150° F.+ feedstocks (those containing greater than 50% wax such as from a Fischer Tropsch process) are preferably first processed through Hydroisomerization Dewaxing.

Solvent Dewaxing to make Lube Base stocks has been used for over 70 years and is described, for example, in *Chemical Technology of Petroleum*, 3rd Edition, William Gruse and Donald Stevens, McGraw-Hill Book Company, Inc., New York, 1960, pages 566 to 570. The basic process involves mixing a waxy hydrocarbon stream with a solvent, typically comprising a ketone (such as methyl ethyl ketone or methyl iso-butyl ketone) and an aromatic (such as toluene), a chilling the mixture to cause wax crystals to precipitate, separating the wax by filtration, typically using rotary drum filters, recovering the solvent from the wax and the dewaxed oil filtrate.

There have been refinements in Solvent Dewaxing since its inception. For example, Exxon's DILCHILL® dewaxing process involves cooling a waxy hydrocarbon oil stock in an elongated stirred vessel, preferably a vertical tower, with a pre-chilled solvent that will solubilize at least a portion of the oil stock while promoting the precipitation of the wax. Waxy oil is introduced into the elongated staged cooling zone or tower at a temperature above its cloud point. Cold dewaxing solvent is incrementally introduced into the cooling zone along a plurality of points or stages while maintaining a high degree of agitation therein to effect substantially instantaneous mixing of the solvent and wax/oil mixture as they progress through the cooling zone, thereby precipitating at least a portion of the wax in the oil. DILCHILL® dewaxing is discussed in greater detail in the U.S. Pat. Nos. 4,477,333, 3,773,650 and 3,775,288. Texaco also has developed refinements in the process. For example, U.S. Pat. No. 5 4,898,674 discloses how it is important to control the ratio of methyl ethylketone (MEK) to toluene and to be able to adjust this ratio, since it allows use of optimum concentrations for processing various base stocks. Commonly, a ratio of 0.7:1 to 1:1 may be used when processing bright stocks; and a ratio of 1.2:1 to about 2:1 may be used when processing light stocks.

Solvent dewaxing tends to reduce the product pour and cloud points to approximately the same value. The solvent dewaxed fraction can optionally be subjected to Catalytic Dewaxing, as described in more detail below.

The lower boiling fractions, e.g., the 1150° F.– fractions, are dewaxed in a Catalytic Dewaxing step to remove high molecular weight n-paraffins.

Catalytic Dewaxing consists to two main classes (Conventional Hydrodewaxing and Hydroisomerization Dewaxing), and Hydroisomerization Dewaxing can be further subdivided into Partial and Complete Hydroisomerization Dewaxing. All classes involve passing a mixture of a waxy hydrocarbon stream and hydrogen over a catalyst that contains an acidic component to convert the normal and slightly branched iso-paraffins in the feed to other non-waxy species and thereby generate a lube base stock product with an acceptable pour point. Typical conditions for all classes involve temperatures from about 400 to 800° F., pressures from about 200 to 3000 psig, and space velocities from about 0.2 to 5 hr-l. The method selected for dewaxing a feed typically depends on the product quality, and the wax content of the feed, with Conventional Hydrodewaxing generally preferred for low wax content feeds. The method for dewaxing can be effected by the choice of the catalyst The general subject is reviewed by Avilino Sequeira, in *Lubricant Base Stock and Wax Processing*, Marcel Dekker, Inc pages 194–223. The determination of the class of Dewaxing Catalyst among Conventional Hydrodewaxing, Partial Hydroisomerization Dewaxing and Complete Hydroisomerization dewaxing can be made by using the n-hexadecane isomerization test as describe by Santilli et al. in U.S. Pat. No. 5,282,958. When measured at 96% n-hexadecane conversion under conditions described by Santilli et al, Conventional Hydrodewaxing Catalysts will exhibit a selectivity to isomerized hexadecanes of less than 10%, Hydroisomerization Dewaxing Catalysts will exhibit a selectivity to isomerized hexadecanes of greater than or equal to 10%, Partial Hydroisomerization Dewaxing Catalysts will exhibit a selectivity to isomerized hexadecanes of greater than 10% to less than 40%, and Complete Hydroisomerization Dewaxing Catalysts will exhibit a selectivity to isomerized hexadecanes of greater than or equal to 40%, preferably greater than 60%, and most preferably greater than 80%.

Conventional Hydrodewaxing is defined for purposes of this document as a Catalytic Dewaxing process that uses a Conventional Hydrodewaxing Catalyst. In Conventional Hydrodewaxing, the pour point is lowered by selectively cracking the wax molecules, mostly to smaller paraffins boiling between propane and about octane. Since this technique converts the wax to less valuable by-products, it is useful primarily for dewaxing oils that do not contain a large amount of wax. Waxy oils of this type are frequently found in petroleum distillate from moderately waxy crudes (Arabian, North Slope, etc). Catalysts that are useful for Conventional Hydrodewaxing are typically 12-ring zeolites and 10-ring zeolites. Zeolites of this class include ZSM-5, ZSM-11, ZSM-22, ZSM-23, ZSM-35, and Mordenite. Conventional Hydrodewaxing catalysts favor cracking in comparison to other method of conversion of paraffins. This is demonstrated by use of the n-hexadecane isomerization test by Santilli et al, in which Conventional Hydrodewaxing catalysts exhibit a selectivity to isomerized hexadecane products of less than 10%. In addition to the zeolites, metals may be added to the catalyst, primarily to reduce fouling. Representative process conditions, yields, and product properties for Conventional Hydrodewaxing are described, for example, U.S. Pat. No. 4,176,050 to Chen et al., U.S. Pat. No. 4,181,598 to Gillespie et al., U.S. Pat. No. 4,222,855 to Peirine et al., U.S. Pat. No. 4,229,282 to Peters et al., U.S. Pat. No. 4,211,635 to Chen, by Sequeira in the section titled "The Mobil Lube Dewaxing Process", pages 198–204 and references therein, J. D. Hargrove, G. J. Elkes, and A. H. Richardson, Oil and Gas J., p. 103, Jan. 15, 1979; the contents of each of which is incorporated herein by reference in their entirety.

Hydroisomerization Dewaxing is defined for purposes of this document as a Catalytic Dewaxing process that uses a Hydroisomerization Dewaxing Catalyst. Hydroisomerization Dewaxing converts at least a portion of the wax to non-waxy iso-paraffins by isomerization, while at the same time minimizing the conversion by cracking. When Conventional Hydrodewaxing and Hydroisomerization Dewaxing are compared on the same feed, the conversion of wax to non-waxy iso-paraffins during Hydroisomerization Dewaxing gives benefits of reducing the yield of less valuable by-products, increasing the yield of lube oil, and generating an oil with higher VI and greater oxidation and thermal stability. Hydroisomerization Dewaxing uses a dual-functional catalyst consisting of an acidic component and a metal component. Both components are required to conduct the isomerization reaction. Typical metal components are platinum or palladium, with platinum most commonly used. The choice and the amount of metal in the catalyst is sufficient to achieve greater than 10% isomerized hexadecane products in the test described by Santilli et al. When the selectivity for hexadecane isomers following Santilli's test exceed 40%, the catalyst is a Complete Hydroisomerization Dewaxing Catalyst. Since Hydroisomerization Dewaxing converts wax to iso-paraffins which boil in the lube base stock range, it is useful for dewaxing oils that contain a large amount of wax. Waxy oils of this type are obtained from slack waxes from solvent dewaxing processes, and distillates from highly waxy crudes (Minas, Altamont, etc.) and products from the Fischer Tropsch Process.

Partial Hydroisomerization Dewaxing is defined for purposes of this document as a Catalytic Dewaxing process that uses a Partial Hydroisomerization Dewaxing Catalyst. In Partial Hydroisomerization Dewaxing a portion of the wax is isomerized to iso-paraffins using catalysts that can isomerize paraffins selectively, but only if the conversion of wax is kept to relatively low values (typically below 50%). At higher conversions, wax conversion by cracking becomes significant, and yield losses of lube base stock becomes uneconomical. The acidic catalyst components useful for Partial Hydroisomerization Dewaxing include amorphous silica aluminas, fluorided alumina, and 12-ring zeolites (such as Beta, Y zeolite, L zeolite). Because the wax conversion is incomplete, Partial Hydroisomerization Dewaxing must be supplemented with an additional dewaxing technique, typically Solvent Dewaxing, Complete Hydroisomerization Dewaxing, or Conventional Hydrodewaxing in order to produce a lube base stock with an acceptable pour point (below about +10° C. or −12° C.). The wax recovered from a solvent dewaxing operation following a Partial Hydroisomerization Dewaxing can be recycled to the Partial Hydroisomerization Dewaxing step. Representative process conditions, yields, and product properties for Partial Hydroisomerization Dewaxing are described, for example, U.S. Pat. No. 5,049,536 to Belussi et al.; U.S. Pat. No. 4,943,672 to Hamner et al., and EP 0 582 347 to Perego et al., EP 0 668 342 to Eilers et al, PCT WO 96/26993 by Apelian et al.; PCT WO 96/13563 by Apelian et al; the contents of each of which is incorporated herein by reference in their entirety.

Complete Hydroisomerization Dewaxing is defined for purposes of this document as a Catalytic Dewaxing process that uses a Complete Hydroisomerization Dewaxing Catalyst. In Complete Hydroisomerization Dewaxing, Complete Hydroisomerization Dewaxing Catalysts are used which can achieve high conversion levels of wax while maintaining acceptable selectivities to isomerization. Since wax conversion can be complete, or at least very high, this process typically does not need to be combined with additional dewaxing processes to produce a lube base stock with an acceptable pour point. Representative process conditions, yields, and product properties for Complete Hydroisomerization Dewaxing are described, for example, in U.S. Pat. No. 5,135,638 to Miller, U.S. Pat. No. 5,246,566 to Miller; U.S. Pat. No. 5,282,958 to Santilli et al.; U.S. Pat. No. 5,082,986 to Miller; U.S. Pat. No. 5,723,716 to Brandes et al; the contents of each of which is incorporated herein by reference in their entirety.

Fischer Tropsch stocks that have 95% points in excess of about 1150° F. (and most preferably those with VI values in excess of 115) should preferably be processed by a combination of operations which first involve isomerization of the paraffins (Hydroisomerization Dewaxing) followed by Solvent Dewaxing. Preferably the Hydroisomerization Dewaxing is a Complete Hydroisomerization Dewaxing process. Fischer Tropsch stocks that have 95% points below about 1150° F. can be processed by Catalytic Dewaxing alone, preferably using Hydroisomerization Dewaxing (most preferably Complete Hydroisomerization Dewaxing) to effect the Catalytic Dewaxing.

Solvent dewaxing and Catalytic Dewaxing can still leave behind trace waxes. The presence of undesired wax can be detected by visual inspection, or using analytical techniques, for example light-scattering turbidity measurement as described in U.S. Pat. No. 4,627,901.

Various methods have been developed for removing these trace contaminants. For example, U.S. Pat. No. 4,950,382 discloses using adsorbents to remove wax. U.S. Pat. Nos. 4,702,817 and 4,820,400 disclose performing electrophoresis on the hydrocarbons during Solvent Dewaxing.

The contents of each of these patents is hereby incorporated herein by reference in their entirety.

One or more of the fractions obtained by Solvent Dewaxing and/or Catalytic Dewaxing (or feedstocks for these processes) may include heteroatoms such as sulfur, oxygen or nitrogen; or olefins that may adversely affect the resulting lube base stock and lube stock compositions; or catalysts or solvents used in dewaxing. If sulfur impurities are present, they can be removed using means well known to those of skill in the art, for example, extractive Merox, hydrotreating, adsorption, etc. Nitrogen-containing impurities can also be removed using means well known to those of skill in the art. Hydrotreating and hydrocracking are preferred means for removing these and other impurities.

Accordingly, the fractions used in the process described herein may be hydrotreated to remove the heteroatoms. As used herein, the term "hydrotreating" are given their conventional meaning and describe processes that are well known to those skilled in the art. Hydrotreating refers to a catalytic process, usually carried out in the presence of free hydrogen, in which the primary purpose is the desulfurization and/or denitrification of the feed stock. Generally, in hydrotreating operations cracking of the hydrocarbon molecules, i.e., breaking the larger hydrocarbon molecules into smaller hydrocarbon molecules, is minimized and the unsaturated hydrocarbons are either fully or partially hydrogenated.

Hydrocracking refers to a catalytic process, usually carried out in the presence of free hydrogen, in which the cracking of the larger hydrocarbon molecules is a primary purpose of the operation. Desulfurization and/or denitrification of the feed stock usually will also occur.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and typical catalysts used in each process.

Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. No. 4,157,294, and U.S. Pat. No. 3,904,513. The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst contain in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not preferred, as the sulfur compounds can interfere with the molecular averaging or Fischer-Tropsch catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); 4,913,799 and the various references cited in U.S. Pat. No. 4,913,799. Mesoporous molecular sieves can also be used, for example the M41S family of materials (*J. Am. Chem. Soc.*, 114:10834–10843 (1992)), MCM-41 (U.S. Pat. Nos. 5,246,689; 5,198,203; 5,334,368), and MCM48 (Kresge et al., *Nature* 359:710 (1992)).

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Hydrotreating may also be used as a final step in the lube base stock manufacturing process. This final step, commonly called hydrofinishing, removes traces of aromatics, olefins, color bodies, and solvents. Clay treating to remove these impurities is an alternative final process step.

The contents of each of the patents and publications referred to above is hereby incorporated by reference in its entirety.

There are several optional upstream processes, each of which have the opportunity to adjust either or both of the 95% and VI values of the lube base stock and lube oils prepared from the base stocks. The feedstocks can be subjected to fractional distillation, and properties maximized by altering the temperatures, draw rates and/or packing materials in the distillation columns, and/or by changing the design of the internals of the columns. These changes will adjust the 95% point but will likely have little effect on the VI.

The feedstocks can be subjected to hydrocracking and/or severe hydrotreating conditions. This will have effects on both the 95% point and the VI. Conversion can be increased by increasing the temperature, thereby increasing the amount of hydrocracking and decreasing the 95% point. The contact time of the product with the hydrocracking catalysts can be increased (for example, by decreasing the WHSV) which will also decrease the 95% point. These changes will likely result in an increased product VI. More effective hydrocracking catalysts will also decrease the 95% point (and may decrease the VI).

In those embodiments in which one or more of the 1150+ and/or 1150° F. – fractions are obtained via Fischer-Tropsch synthesis, the chain length of the hydrocarbon products can be altered by altering the syngas hydrogen/carbon monoxide ratio, the reaction temperature and/or changing the catalyst.

The lube base stock properties can also be adjusted by blending (before or after the process is performed). For example, by blending a lube base stock prepared according to the process described herein with a lube base stock with a higher 95% point, for example, a 95% point above 1150° F., one can increase the 95% point. Analogously, adding a lube base stock with a VI value higher or lower than the VI of the product stream will raise or lower the VI of the resulting blend. This approach can be used to upgrade otherwise unacceptable product streams to produce salable products.

The lube base stock prepared according to the process described herein can have virtually any desired average molecular weight, depending on the desired physical and chemical properties of the lube stock composition, for example, pour point, viscosity, viscosity index and the like. The average molecular weight can be controlled by adjusting the boiling range or carbon number range and proportions of the Solvent Dewaxed and catalytically dewaxed fractions. The preferred lube base stock composition can generally be described as including hydrocarbons in the $C_{20-50}$ range that include branching typical of that observed in compositions subjected to Catalytic Dewaxing preferably Hydroisomerization Dewaxing processes.

Preferably, the lube base stock is obtained, at least in part, via Solvent Dewaxing and Catalytic Dewaxing of fractions derived from Fischer-Tropsch synthesis, and therefore, contains a minimum of heteroaroms and aromatics and other cyclic compounds. Most preferably the Catalytic Dewaxing process uses a Hydroisomerization Dewaxing Catalyst, and most preferably a Complete Hydroisomerization Dewaxing Catalyst.

Lube stock compositions with boiling points in the range of between about 650 and 1400° F. are preferred, with boiling points in the range of between about 700 and 1200° F. being more preferred. However, the process is adaptable to generate higher or lower boiling lube oils.

In a preferred embodiment, the lube base stock composition includes branched hydrocarbons. Preferred Catalytic Dewaxing catalyst and conditions tend to form isoparaffins. Solvent Dewaxing does not form isoparaffins, but rather, removes waxy paraffins from a product. Thus for waxy feedstocks, the feedstock to the Solvent Dewaxing process is first subjected to Hydroisomerization Dewaxing (preferably Complete Hydroisomerization Dewaxing). The solvent dewaxed fraction can optionally be subjected to hydroisomerization conditions to provide additional branching.

The lube base stock and/or lube stock compositions preferably have pour points in the range of 10° C. or lower, more preferably 0° C. or lower, still more preferably, −15° C. or lower, and most preferably, between −15 and −40° C. The degree of branching in the compositions is preferably kept to the minimum amount needed to arrive at the desired pour point or cloud point. Pour point depressants can be added to adjust the pour point to a desired value.

The lube base stock and/or lube stock compositions preferably have a viscosity index (a measure of the resistance of viscosity change to changes in temperature) of at least 100, more preferably at least 115, most preferably 140 or more. Further, the compositions preferably have a pour point (as measured, for example, by ASTM 97, which measures the temperature at which an oil no longer will flow when it is cooled) of less than 10° F. The compositions preferably have a cloud point (as measured, for example, by ASTM D 2500, which measures the temperature at which a cloud appears in the lube base stock as it is cooled) of less than about 14° F. The ASTM 97 and D 2500 procedures are well known to those of skill in the art.

Further definitions of lube base oil and lube base stock are in API Publication 1509.

The lube base oil and/or lube base stock compositions can be blended with suitable additives to form the lube oil composition (also commonly known as a finished lube oil or simply lube oil or lubricant). The lube oil composition includes various additives, such as lubricity improvers, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour point depressants, detergents, rust inhibitors and the like. Other hydrocarbons, such as those described in U.S. Pat. No. 5,096,883 and/or U.S. Pat. No. 5,189,012, may be blended with the lube oil provided that the final blend has the necessary pour point, kinematic viscosity, flash point, and toxicity properties. The total amount of additives is preferably between 1–30 percent. All percentages listed herein are weight percentages unless otherwise stated. (Additives are commonly provided as a mixture with a diluent oil prior to blending with the lube base stock and or base oil.)

Examples of suitable lubricity improvers (also known as friction modifiers) include polyol esters of $C_{12-28}$ acids.

Examples of viscosity modifying agents include polymers such as ethylene alpha-olefin copolymers which generally have weight average -molecular weights of from about 10,000 to 1,000,000 as determined by gel permeation chromatography.

Examples of suitable corrosion inhibitors include phosphosulfurized hydrocarbons and the products obtained by reacting a phosphosulftuized hydrocarbon with an alkaline earth metal oxide or hydroxide.

Examples of oxidation inhibitors include antioxidants such as alkaline earth metal salts of alkylphenol thioesters having preferably C5–C12 alkyl side chain such as calcium nonylphenol sulfide, barium t-octylphenol sulfide, dioctylphenylarnine as well as sulfurized or phosphosulfurized hydrocarbons. Additional examples include oil soluble antioxidant copper compounds such as copper salts of C10 to C18 oil soluble fatty acids.

Examples of friction modifiers include fatty acid esters and arnides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof.

Pour point depressants such as C8–C18 dialkyl fumarate vinyl acetate copolymers, polymethacrylates and wax naphthalene are well known to those of skill in the art.

Examples of anti-foaming agents include polysiloxanes such as silicone oil and polydimethyl siloxane; acrylate polymers are also suitable.

Examples of anti-wear agents include zinc dialkyldithiophosphate, zinc diaryl diphosphate, and sulfurized isobutylene.

Examples of detergents and metal rust inhibitors include the metal salts of sulfonic acids, alkylphenols, sulfurized alkylphenols, alkyl salicylates, naphthenates and other oil soluble mono and dicarboxylic acids such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

Antioxidants can be added to the lube oil to neutralize or minimize oil degradation chemistry. Examples of antioxidants include those described in U.S. Pat. No. 5,200,101, which discloses certain amine/hindered phenol, acid anhydride and thiol ester-derived products.

Additional lube oils additives are described in U.S. Pat. No. 5,898,023 to Francisco, et al., the contents of which are hereby incorporated by reference.

The resulting lube oil compositions can be used, for example, in automobiles. When derived in whole in large part from Fischer-Tropsch wax, the high paraffinic nature of the lube oil gives it high oxidation and thermal stability, and the lube oil has a high boiling range for its viscosity, i.e., volatility is low, resulting in low evaporative losses.

The lube oil compositions can also be used as a blending component with other oils. For example, the lube oil can be used as a blending component with polyalpha-olefins, or with mineral oils to improve the viscosity and viscosity index properties of those oils, or can be combined with isomerized petroleum wax. The lube oils can also be used as workover fluids, packer fluids, coring fluids, completion fluids, and in other oil field and well-servicing applications. For example, they can be used as spotting fluids to unstick a drill pipe that has become stuck, or they can be used to replace part or all of the expensive polyalphaolefin lubricating additives in downhole applications. Additionally, they can also be used in drilling fluid formulations where shale-swelling inhibition is important, such as those described in U.S. Pat. No. 4,941,981 to Perricone et al.

The present invention will be better understood with reference to the following non-limiting examples.

Example 1

Formation of Lube Base Stock Compositions

A series of Hydroisomerization Dewaxing catalysts were prepared and tested. The object was to find methods where the pour-cloud spread was minimized. Between 0.25 and 10 grams of catalyst were loaded in tubular reactors, reduced with hydrogen, and evaluated with various waxy lubricant oils. From this study results that generate lube base stocks with pour points between −25 and 0° C. were selected. All catalysts contained zeolites and molecular sieves known to be useful for Hydroisomerization Dewaxing either Complete or Partial. Catalysts tested include the samples of the following structures either in pure phase or in combination: SSZ-20,-25, -28, -31, -32, -41 , -43, and -54; SAPO-11,-31, and -41; ZSM-5, 11, 12,-23, and 48; Mordenite, Ferrerite, Beta, SUZ-4 and EU-1.

The ranges of feedstocks and process conditions are shown below.

| Variable | Maximum Value | Minimum Value | Average |
|---|---|---|---|
| Feed Paraffinic Carbon, ndM | 99.4 | 51.2 | 72.4 |
| Feed Saturates by HPLC | 96.0 | 51.0 | 86.1 |
| Feed Wax, Wt % | 83.2 | 7.9 | 25.5 |
| Feed 50% point by D2887, ° F. | 1198 | 633 | 887 |
| Feed 95% point by D2887, ° F. | 1360 | 696 | 1001 |
| Feed 99% point by D2887, ° F. | 1400 | 707 | 1048 |
| Feed Sulfur, ppm | 1500 | 1.96 | 35.5 |
| Feed Nitrogen, ppm. | 120.96 | 0.05 | 2.01 |
| Feed Oxygen, ppm | 2480 | 9.0 | 367 |
| Feed VI | 197 | 76 | 118 |
| Catalyst Temperature, ° F. | 790 | 451 | 652 |
| Pressure, psig | 2450 | 200 | 2082 |
| WHSV, h-1 | 18.54 | 0.24 | 1.81 |
| Conversion, Wt % | 96.4 | 0.24 | 18.42 |
| H2 Rate, SCFB | 24,714 | 1367 | 3910 |

The factors that were found to have a significant impact on the pour-cloud spread were a surprising combination of both feedstock boiling range (as measured by the heaviest fractions) and the viscosity index of the product. The trends showed that the pour-cloud spread depends primarily on the product 95% point, and also on the product VI. Even selective Complete Hydroisomerization Dewaxing catalysts were not able to achieve products with low pour-cloud spread from feedstocks that had both 95% points in excess of 1150° F. and VI values in excess of 115.

Based on the data obtained, the following factors are not believed to be significantly responsible for the pour-cloud spread:

Structure of the zeolite or molecular sieve in the catalyst.
Feed sulfur content
Feed nitrogen content
Feed oxygen content
Catalyst temperature
Pressure of operation
WHSV
Conversion
Gas Rate As the product's VI increases, and as the product's 95% point increases, the spread in pour-cloud can increase. For lube base stocks with 95% points below 1150° F., there is very little trend for the pour-cloud spread to increase with increase in product VI. It is approximately constant at 7° C. However, when stocks with 95% points in excess of 1150° F. are examined, pour cloud spread is much higher, and the product VI plays a much stronger role. Products from feedstocks with 95% points below 1150° F. are in general, less viscous than products from feedstocks with 95% points above 1150° F.

| | 95% Pt Range | | | |
|---|---|---|---|---|
| | ≦1150 | ≦1150 | >1150 | >1150 |
| | VI Range | | | |
| | ≦115 | >115 | ≦115 | >115 |
| | No. Data Points | | | |
| | 2744 | 869 | 95 | 134 |
| 95% Point Data, ° F. | | | | |
| 95% Minimum | 800 | 696 | 1160 | 1151 |
| 95% Maximum | 1035 | 1125 | 1290 | 1360 |
| 95% Average | 992 | 952 | 1280 | 1277 |
| VI Data | | | | |
| VI Minimum | 60.9 | 115.1 | 97 | 115 |
| VI Maximum | 115 | 172 | 114.9 | 170 |
| VI Average | 101.4 | 130.9 | 108 | 129.6 |
| Pour-Cloud Spread Data, ° C. | | | | |
| P-C Minimum | −15 | −3 | 3 | 12 |
| P-C Maximum | 69 | 56 | 46 | 67 |
| P-C Average | 6.7 | 8.5 | 22.8 | 33.3 |

The change in the pour-cloud spread with product VI for stocks with 95% points in excess of 1150° F. is much larger than for stocks with 95% points below 1150° F. For stocks with 95% points in excess of 1150° F. and with conventional VI values (i.e., less than about 115) the expected pour-cloud spread will be approximately 30° C., which is acceptable. However, for stocks with a combination of 95% points in excess of 1150° F. and with VI values in excess of 115, the pour-cloud spread can be much larger, about 33° C. and in some cases approaching 60° C.

Pour-cloud spreads above about 30° C. are undesirable because they require the process to dewax the base stock to very low pour points in order to meet the cloud point specification. This in turn results in unacceptable yield losses. The process described herein avoids these yield losses by Solvent Dewaxing stocks that have a combination of 95% points in excess of 1150° F., preferably but not necessarily with VI values above 115, and catalytically dewaxing stocks with 95% points less than 1150° F.

Fischer Tropsch stocks that have wax contents in excess of 50%, and that have 95% points in excess of about 1150° F. (and most preferably those which generate base stocks with VI values in excess of 115) should preferably be processed by a combination of operations which first involve isomerization of the paraffins (Hydroisomerization Dewaxing) followed by Solvent Dewaxing. Preferably the Hydroisomerization Dewaxing is a Complete Hydroisomerization Dewaxing process. Fischer Tropsch stocks that have 95% points below about 1150° F. can be processed by Catalytic Dewaxing alone, preferably using Hydroisomerization Dewaxing (most preferably Complete Hydroisomerization Dewaxing) to effect the Catalytic Dewaxing.

While the above data are presented in terms of the product properties, there are also good correlations with the waxy feedstock. For the 95% points, the product and feed values are essentially equivalent. The waxy feed VI tends to be higher than the product VI. For example, a product VI of 115 is roughly equivalent to a waxy feedstock VI of 128 for an average feedstock as evaluated in Example 1. The VI of a waxy feedstock can be determined by measuring the viscosity at two temperatures where it is fluid, say 70° C. and 100C, and then by extrapolation of a value at 40° C., which is used in the VI calculation.

While the present invention has been described with reference to specific embodiments, this application is intended to cover those various changes and substitutions that may be made by those skilled in the art without departing from the spirit and scope of the appended claims.

What is claimed:

1. A process for preparing lube base stocks, the process comprising:

a) obtaining a first hydrocarbon fraction with a 95% point above 1150° F. as measured by ASTM D2887 and a second hydrocarbon fraction with a 95% point below 1150° F. as measured by ASTM D2887;

b) subjecting the first hydrocarbon fraction to a Solvent Dewaxing process to obtain a lube base stock with a VI of greater than or equal to 115; and c) subjecting the second hydrocarbon fraction to a Catalytic Dewaxing process with no solvent Dewaxing to obtain a lube base stock having a viscosity less than the viscosity of the lube base stock of step b).

2. The process of claim 1 further comprising the step of subjecting one or both of the first hydrocarbon fraction and the second hydrocarbon fraction to hydrotreatment, wherein the hydrotreatment is conducted prior to or after the dewaxing process.

3. The process of claim 1 further comprising the step of subjecting the first hydrocarbon fraction to a Catalytic Dewaxing process, wherein the Catalytic Dewaxing process is conducted prior to or after the Solvent Dewaxing process.

4. The process of claim 3, wherein the Catalytic Dewaxing process conducted on the first hydrocarbon fraction is a Hydroisomerization Dewaxing process.

5. The process of claim 4, wherein the Hydroisomerization Dewaxing process conducted on the first hydrocarbon fraction is a Complete Hydroisomerization Dewaxing process.

6. The process of claim 1, wherein the Catalytic Dewaxing process conducted on the second hydrocarbon fraction is a Hydroisomerization Dewaxing process.

7. The process of claim 6, wherein the Hydroisomerization Dewaxing process conducted on the second hydrocarbon fraction is a complete Hydroisomerization Dewaxing process.

8. The process of claim 1, wherein at least a portion of one of the hydrocarbon fractions is derived from the group consisting of Fischer-Tropsch synthesis products, slack waxes from conventional petroleum lube production, distillates from crude oil, deasphalted residual stocks from crude oil, and combinations thereof.

9. The process of claim 8, wherein at least a portion of one of the hydrocarbon fractions is derived from Fischer-Tropsch synthesis products.

10. The process of claim 1, wherein the lube base stocks each have a pour point/cloud point spread of less than 30° C.

11. The process of claim 1, wherein the lube base stocks each have a pour point/cloud point spread of less than 10° C.

12. The process of claim 1, wherein the pour point of at least one of the lube base stocks is less than −10° C.

13. The lube base stocks produced from the process according to claim 1 each having a pour point between −15 and −40° C., a VI above 115, a cloud point of less than −10° C., and a sulfur content of less than 300 ppm.

14. The lube base stocks according to claim 13, wherein at least one of the lube base stocks further comprises one or more lube oil additives selected from the group consisting of lubricity improvers, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour point depressants, detergents, and rust inhibitors.

15. The process of claim 1, wherein at least one of the lube base stocks is combined with one or more lube oil additives selected from the group consisting of lubricity improvers, emulsifiers, wetting agents, densifiers, fluid-loss additives, viscosity modifiers, corrosion inhibitors, oxidation inhibitors, friction modifiers, demulsifiers, anti-wear agents, dispersants, anti-foaming agents, pour-point depressants, detergents, and rust inhibitors.

16. A process for preparing lube base stocks, having pour-cloud spreads less than 30° C., the process comprising:

a) fractionating a lube base stock feedstock into at least a heavier and a lighter fraction;

b) catalytically dewaxing the fractions using a Hydroisomerization Dewaxing Catalyst, providing dewaxed lube base stocks;

c) measuring the pour-cloud spreads of the dewaxed lube base stocks; and d) modifying the process to decrease the pour-cloud spreads of the dewaxed lube base stocks if the measured pour-cloud spreads exceed 30° C. by adjusting the fractionation cut point, adjusting the fractionation efficiency, Solvent Dewaxing the dewaxed lube base stocks, adsorbent treating the lube base stocks, and or combinations thereof, whereby the process produces lube base stocks have having a pour point between −15 and −40° C., a VI above 115, a cloud point of less than −10° C., and a sulfur content of less than 300 ppm.

17. A process for preparing lube base stocks, the process comprising:

a) providing a Fischer Tropsch waxy feedstock;

b) fractionating the Fischer Tropsch waxy feedstock into a first hydrocarbon fraction, having a 95% point above 1150° F. as measured by ASTM D2887 and a pour-cloud spread of greater than 30° C., and a second hydrocarbon fraction, having a 95% point below 1150° F. as measured by ASTM D2887 and a pour-cloud spread of approximately 7° C. or less;

c) subjecting the first hydrocarbon fraction to a Hydroisomerization Dewaxing process and Solvent Dewaxing process to obtain a lube base stock with a VI of greater than or equal to 115; and d) subjecting the second hydrocarbon fraction to a Hydroisomerization Dewaxing process with no Solvent Dewaxing to obtain a lube base stock having a viscosity less than the viscosity of the lube base stock of step b).

18. The process of claim 17, wherein the first hydrocarbon fraction is subjected to a Complete Hydroisomerization Dewaxing Process followed by a Solvent Dewaxing process.

19. The process of claim 17, wherein the lube base stock of step b) and the lube base stock of step c) are blended to provide a blended lube base stock with a pour point of ≦0° C., a VI of greater than 115, and a cloud point of less than −10° C.

20. The process of claim 17, further comprising recovering wax from the Solvent Dewaxing process of step b) and recycling it to the Hydroization Dewaxing of the first hydrocarbon fraction in step b).

* * * * *

UNITED STATES PATENT AND TRADEMARK OFFICE

CERTIFICATE OF CORRECTION

PATENT NO. : 6,773,578 B1
DATED : August 10, 2004
INVENTOR(S) : Dennis J. O'Rear et al.

It is certified that error appears in the above-identified patent and that said Letters Patent is hereby corrected as shown below:

Column 18,
Line 61, please delete "Hydroization" and insert in place thereof -- Hydroisomerization --.

Signed and Sealed this

Eighteenth Day of January, 2005

JON W. DUDAS
*Director of the United States Patent and Trademark Office*